US008879897B1

(12) United States Patent
Ciliento

(10) Patent No.: US 8,879,897 B1
(45) Date of Patent: Nov. 4, 2014

(54) METHOD AND APPARATUS TO DELIVER HEATED WATER FOR MIXING MASONRY MATERIALS

(76) Inventor: Joseph Ciliento, Ballston Lake, NY (US)

( * ) Notice: Subject to any disclaimer, the term of this patent is extended or adjusted under 35 U.S.C. 154(b) by 303 days.

(21) Appl. No.: 13/352,577

(22) Filed: Jan. 18, 2012

Related U.S. Application Data

(60) Provisional application No. 61/434,025, filed on Jan. 19, 2011.

(51) Int. Cl.
*H05B 3/60* (2006.01)
*F24H 1/18* (2006.01)

(52) U.S. Cl.
USPC ..... 392/322; 392/441; 392/447

(58) Field of Classification Search
None
See application file for complete search history.

(56) References Cited

U.S. PATENT DOCUMENTS

| | | | | | |
|---|---|---|---|---|---|
| 2,614,571 | A | * | 10/1952 | Turpin | 134/61 |
| 3,668,710 | A | * | 6/1972 | Dowd | 4/597 |
| 3,687,128 | A | * | 8/1972 | Williams | 122/18.4 |
| 3,807,706 | A | * | 4/1974 | Kugle et al. | 366/27 |
| 4,159,877 | A | * | 7/1979 | Jacobson et al. | 366/22 |
| 4,454,613 | A | * | 6/1984 | Palmer | 4/300 |
| 4,692,028 | A | * | 9/1987 | Schave | 366/22 |
| 4,785,792 | A | * | 11/1988 | Saint Laurent | 126/344 |
| D298,946 | S | * | 12/1988 | Schave et al. | D15/13 |
| 4,887,741 | A | * | 12/1989 | Downing | 222/146.5 |
| 4,947,025 | A | * | 8/1990 | Alston et al. | 392/481 |
| 4,993,402 | A | * | 2/1991 | Ripka | 122/18.2 |
| 5,076,494 | A | * | 12/1991 | Ripka | 237/19 |
| 5,704,989 | A | * | 1/1998 | Page | 134/10 |
| 5,713,310 | A | * | 2/1998 | Lemke | 122/248 |
| 5,718,015 | A | * | 2/1998 | Rohrbacher | 15/321 |
| 5,826,298 | A | * | 10/1998 | Rohrbacher et al. | 15/321 |
| 5,832,178 | A | * | 11/1998 | Schave | 392/472 |
| 5,974,227 | A | * | 10/1999 | Schave | 392/478 |
| 6,049,658 | A | * | 4/2000 | Schave et al. | 392/472 |
| 6,170,440 | B1 | * | 1/2001 | Monnier et al. | 122/367.1 |
| 6,189,944 | B1 | * | 2/2001 | Piche | 296/22 |
| 6,594,447 | B2 | * | 7/2003 | Rixen | 392/496 |
| 7,460,769 | B2 | * | 12/2008 | Ryks | 392/490 |
| 7,644,686 | B2 | * | 1/2010 | Threatt et al. | 122/37 |
| 8,366,014 | B2 | * | 2/2013 | Ene et al. | 237/19 |
| D679,787 | S | * | 4/2013 | Lesage | D23/318 |
| 2003/0113107 | A1 | * | 6/2003 | Winter et al. | 392/447 |
| 2003/0123863 | A1 | * | 7/2003 | Hughes et al. | 392/449 |
| 2004/0010847 | A1 | * | 1/2004 | Braxton | 4/664 |
| 2008/0152331 | A1 | * | 6/2008 | Ryks | 392/490 |
| 2009/0107107 | A1 | * | 4/2009 | Bell | 60/200.1 |
| 2010/0238757 | A1 | * | 9/2010 | Capps | 366/22 |
| 2011/0131752 | A1 | * | 6/2011 | Place | 15/320 |
| 2012/0167297 | A1 | * | 7/2012 | Poust | 4/321 |
| 2013/0034344 | A1 | * | 2/2013 | Lutz et al. | 392/449 |
| 2013/0087175 | A1 | * | 4/2013 | Petter et al. | 134/36 |
| 2013/0145996 | A1 | * | 6/2013 | Cooper et al. | 122/31.2 |

* cited by examiner

*Primary Examiner* — Thor Campbell
(74) *Attorney, Agent, or Firm* — Maxine L. Barasch; Keohane & D'Alessandro, PLLC

(57) ABSTRACT

An apparatus and method to deliver hot water for mixing masonry materials is disclosed. The apparatus comprises a platform, bottom receptacles to provide for transport by a forklift, at least one holder for a fuel tank, at least two holders for tanks for water storage, at least one support for a heater, at least one water heater with a cover and a vent, and a grated floor area under the water heater support to allow for drainage of the water heater.

13 Claims, 8 Drawing Sheets

METHOD AND APPARATUS TO DELIVER HEATED WATER FOR MIXING MASONRY MATERIALS

CROSS REFERENCE TO RELATED APPLICATIONS

This application claims priority to U.S. Provisional Patent Application 61/434,025, filed Jan. 19, 2011, the entirety of which is incorporated herein by reference.

FIELD OF THE INVENTION

The present invention relates generally to construction equipment, and more particularly to a method and apparatus to deliver heated water for mixing masonry materials.

BACKGROUND

Portland cement containing materials are commonly used in the construction industry for structural elements, including but not limited to mortar for bricks, concrete, and other masonry applications. Ideal conditions for preparing masonry exist at or above approximately 40° F. (4.4° C.); however, below this temperature (also known as "cold masonry") masonry workers must use additional safe guards to enable masonry preparations that meet industry building standards. Cold masonry delays tooling and settling times of mixtures and results in a lower bonding strength, and for colored masonry, results in color inconsistencies. Cold masonry can also result in the water in the mortar freezing and disrupting the expansion process.

Current practices to enable masonry workers to work in conditions lower than 40° F. include 1) heating the sand or mixing water to reach a mortar temperature between 40° F. and 120° F. (4.4° C. and 48.9° C.) at the time of mixing; 2) heating materials to produce a grout temperature between 70° F. and 120° F. (21.1° C. and 48.9° C.) at the time of mixing; 3) heating masonry surfaces to at least 40° F. during construction; and 4) using enclosures and/or wind breaks to provide for an environment warm enough to properly prepare the masonry material.

Providing heated water to prepare masonry material can include use of a hot water tap or external heating of barrels of water, primarily with propane burners. As is typically practiced in the art, the propane burners project a flame on barrels of water. This practice poses several problems, including 1) inconsistent delivery of heat, such that the water temperature for mixing masonry is not controlled; 2) safety issues, as workers must prepare mixtures near an open flame; and 3) on particularly cold or windy days, the propane burners may not be able to deliver a flame for sufficient time to properly heat the mixing water. Additionally, the propane burners lose a lot of heat to ambient conditions, thus increasing the usage of propane and the cost.

The current methods used to provide heated water to prepare masonry materials allow for masonry construction projects to outside air temperatures of about 20° F. (−6.7° C.). However, at outside air temperatures of below 20° F., masonry construction projects become increasingly difficult. Most masonry construction projects do not occur at temperatures below 5° F. to 10° F. because of the difficulties discussed above.

The above problems with heating water to prepare masonry result in shorter working seasons, inefficient work times when on the site, and safety issues. Additionally, these problems lead to increased cost for preparing masonry during cold weather, inconsistent mixtures, poorer quality materials, and can result in additional cost to correct poorly bonded masonry or, in the case of colored masonry, correcting color variations. Therefore, a need exists to provide a method and apparatus to provide heated water for mixing masonry materials during cold weather that results in lower cost preparations, consistent material mixtures, increased worker safety, longer working seasons, and more efficient work times while on the site.

Construction sites may not necessarily have the water source adjacent to the equipment used to heat the water to mix the masonry materials. This results in having to transport the water needed for mixing masonry materials across a work site. This can cause further worker inefficiencies on a working day. Additionally, construction sites tend to have several persons, equipment and machinery in a limited space. It is common for several teams of workers to be present on the site. Therefore a need exists to provide for a space-efficient manner to contain the equipment needed for providing heated water to mix masonry materials.

SUMMARY

An apparatus to deliver hot water for mixing masonry materials (also described as a hot water platform) is disclosed. In one embodiment, the apparatus comprises a powder-coated steel frame and bottom support member (together comprising the chassis), bottom receptacles to provide for transport by a forklift, at least one holder for a pressurized propane tank, at least one liquid propane tank, at least one or two holders for 55 gallon tanks for water storage, at least one or two 55 gallon tanks, at least one support (mount) for a water heater, at least one fueled (e.g. with propane) heater with a cover and a vent, and a grated floor area under the propane heater support to allow for drainage of the heater.

The chassis (platform) of the hot water platform comprises framing around the perimeter of the bottom support member, such that the holders for the propane tanks, the water storage tanks, and the heater supports are contained within the framing. The bottom receptacles are situated on the bottom of the chassis.

In one embodiment, the apparatus provides for manual user operation of filling one or both of the water storage tanks, or alternatively, automatic closed loop control.

A method to deliver heated water for mixing masonry materials is disclosed. In one embodiment, the method comprises: attaching a source of water to the inlet of the heater; attaching a hose to the outlet of the heater; providing a source of electricity for the heater controls and pump (if used); providing a source of propane to the propane heater; adjusting the propane heater's thermostat to the desired temperature; flowing water through the propane heater; and collecting the heated water into one of the water storage tanks.

The method described above may be manual or use an automatic control loop to operate the device.

Under the standard methods to mix masonry materials, mixing costs are about $0.12/gallon. Using the method and apparatus disclosed herein, mixing costs are about $0.035 cents/gallon, a savings of at least 300%. When using an open flame to heat water used to mix masonry materials, a worker typically uses a 1 million BTU open flame source. Using the apparatus and method disclosed herein, a worker can use a 200,000 BTU water heater without an open flame. Finally, the method and apparatus disclosed herein allow for masonry construction projects at temperatures to as low as −20° F.

The use of the disclosed apparatus and method to deliver hot water for mixing masonry materials provides the benefits of 1) shortened set-up time to heat the water from approximately 45 minutes to five to ten minutes; 2) improved safety at work sites, as the means for heating the water does not involve the use of an open flame; 3) increased temperature uniformity of water used to mix masonry materials; 4) increased consistency in masonry materials prepared in cold weather; 5) increased color uniformity in colored masonry materials; 6) more efficient working time on masonry construction projects; 7) longer working seasons for masonry construction projects; 8) lower costs to prepare masonry materials for construction projects in cold weather; and 9) lower costs to correct non-uniformities in color for colored masonry.

In one embodiment, a water heating apparatus is provided. The apparatus comprises a platform, a tankless water heater attached to the platform, the tankless water heater comprising a water input and a water output, a fuel tank holder attached to the platform, the fuel tank holder configured and disposed to secure a fuel tank, and a first water reservoir, wherein the first water reservoir is configured and disposed to receive heated water from the water output of the tankless water heater.

In another embodiment, a water heating apparatus is provided. The apparatus comprises: a platform; a tankless water heater attached to the platform, the tankless water heater comprising a water input and a water output; a fuel tank holder attached to the platform, the fuel tank holder configured and disposed to secure a fuel tank; a first water reservoir, wherein the first water reservoir is configured and disposed to receive heated water from the water output of the tankless water heater; a second water reservoir; a submersible pump disposed within the second water reservoir, wherein the submersible pump is configured to pump water into the tankless water heater via an input conduit; a pair of forklift receptacles disposed below the platform; an elevation system, wherein the elevation system is configured and disposed to elevate the platform a predetermined distance above the ground; a combustion engine generator affixed to the platform, said generator configured and disposed to supply electricity to the tankless water heater and submersible pump; an output spigot, the output spigot disposed in a lower portion of the first water reservoir, wherein the output spigot is configured and disposed to controllably release water from the first water reservoir; a first level indicator and a second level indicator, wherein the first level indicator and second level indicator are disposed on the platform, and wherein the first level indicator and second level indicator are configured and disposed to indicate the levelness of the platform; a grated floor region disposed in the platform below the tankless water heater; and a plurality of hoist fixtures configured and disposed on the platform, thereby enabling hoisting of the water heating apparatus.

In another embodiment, a method for delivering heated water to a construction site is provided. The method comprises: providing a source of water to an input of a tankless water heater; providing a source of fuel to the tankless water heater; providing a source of electricity to the tankless water heater; adjusting a thermostat on the tankless water heater to a desired temperature, flowing water through the tankless water heater; and collecting heated water from the tankless water heater in an output water reservoir.

This Summary is provided to introduce a selection of concepts in a simplified form that are further discussed below in the Detailed Description. This Summary is not intended to identify key features or essential features of the subject matter, nor is it intended to be used to limit the scope of the claimed subject matter. Other details, features, utilities and advantages of the claimed subject matter, will be apparent from the following more particularly written Detailed Description.

Figure 1:
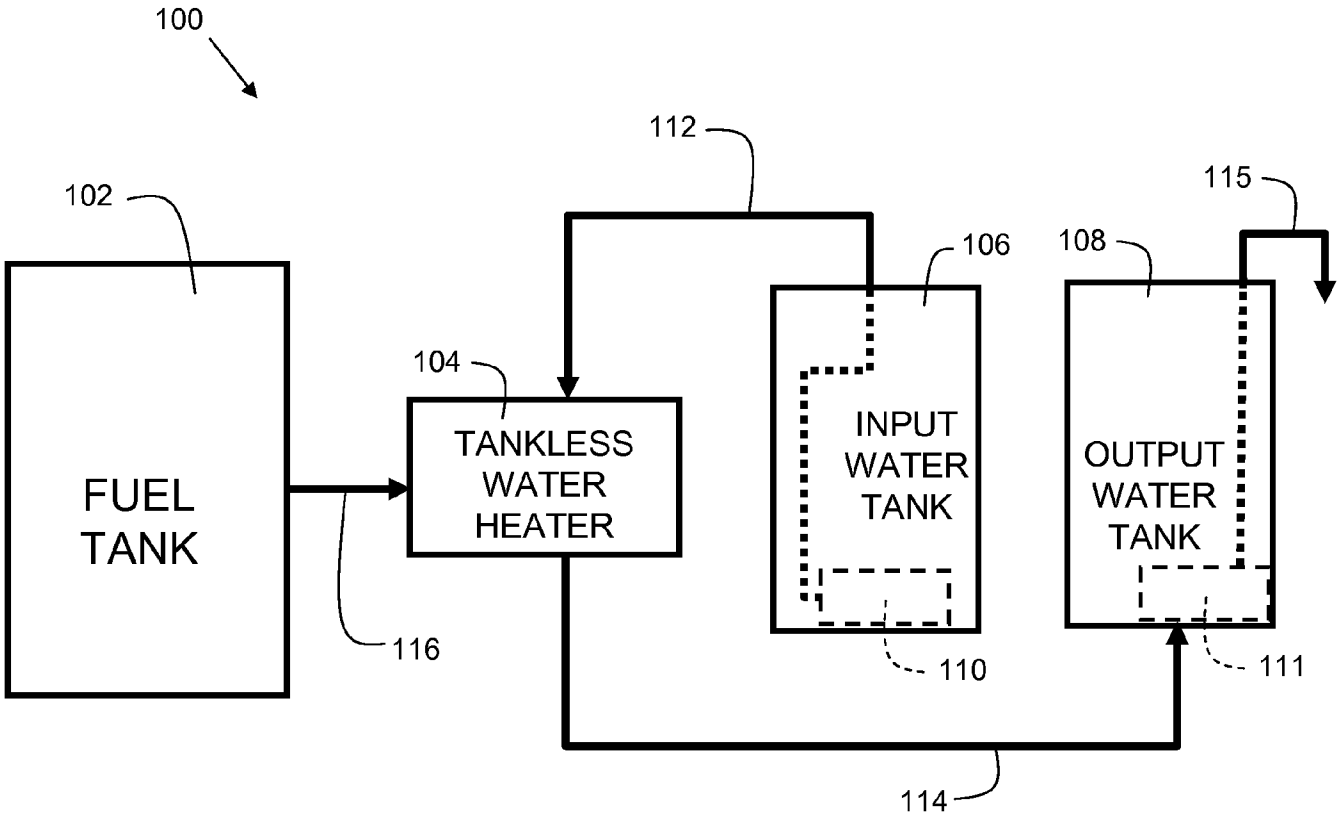
FIG. 1 shows a system diagram of an embodiment of the present invention.

It will be recognized that the drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering may represent like elements.

DETAILED DESCRIPTION

Referring now to FIGS. 1 through 7, details of embodiments of the present invention will be described herein below.

FIG. 1 shows a system diagram of a heating system 100 in accordance with an embodiment of the present invention. Heating system 100 comprises fuel tank 102, which preferably contains a pressurized fuel source, such as propane. It will be recognized that other fuel sources may be substituted for propane, and all feasible such fuel sources are included within the scope of the invention. Conduit 116 supplies fuel from fuel tank 102 to tankless water heater 104. In one embodiment, the tankless water heater 104 is a model RC80HPi from Rinnai Corporation of Peachtree City, Ga. Submersible pump 110 serves as an input pump, and pumps water from input water tank (reservoir) 106 to tankless water heater 104 via input conduit 112. Heated water exits the water heater 104 via output conduit 114 and is fed into output water tank (reservoir) 108, where it can then be used in the concrete mixing process. Submersible pump 111 serves as an output pump, and pumps water from output water tank (reservoir) 108 via output conduit 115 for use in mixing masonry materials.

Figure 1A:
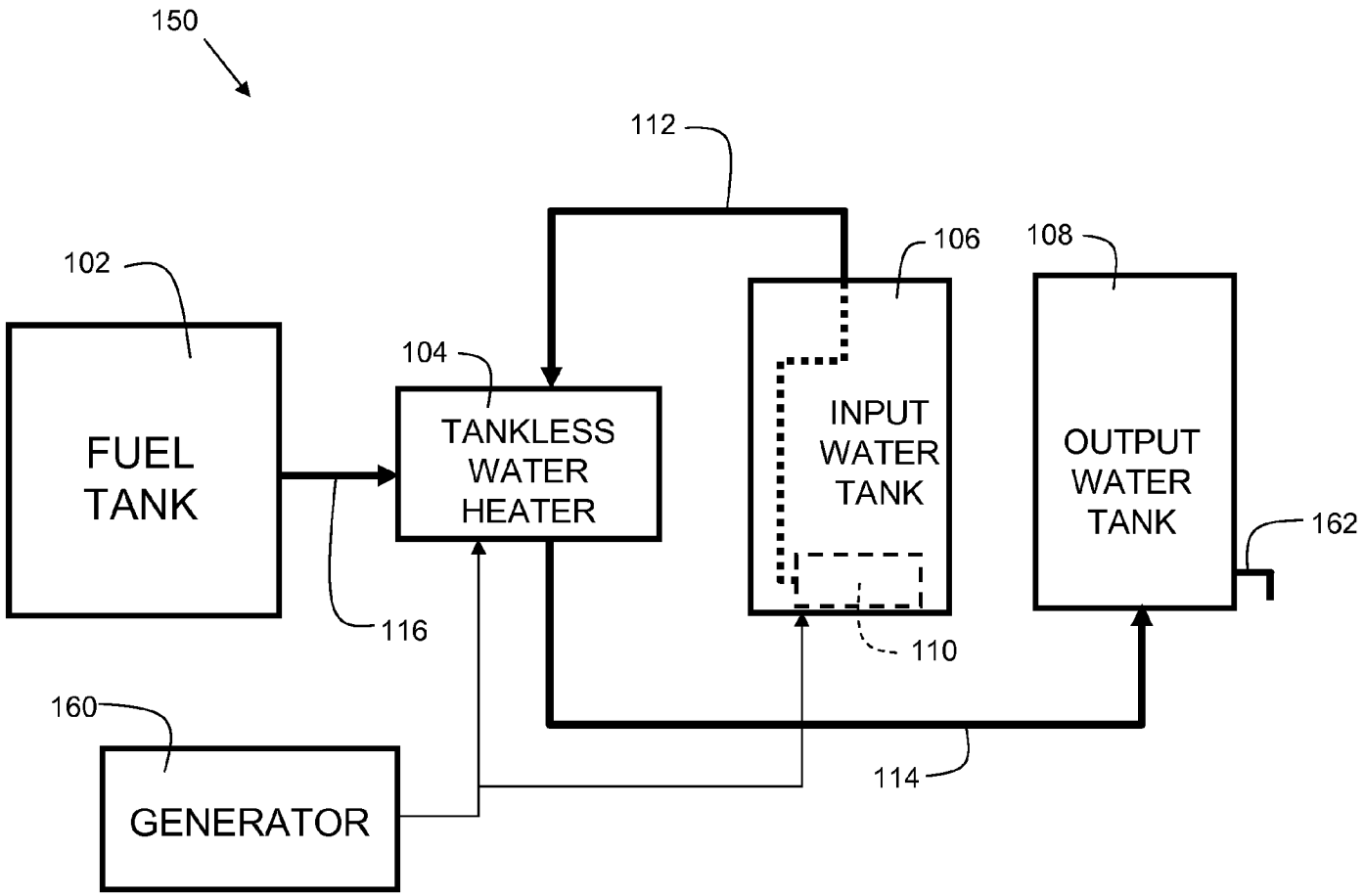
FIG. 1A shows a system diagram of another embodiment of the present invention.

FIG. 1A shows a system diagram of a heating system 150 in accordance with another embodiment of the present invention. In this embodiment, a combustion engine generator 160 is included in system 150. The combustion engine generator may be, for example, gasoline or diesel powered. It will be recognized that other power sources may be substituted for those disclosed, and all feasible sources are included within the scope of the invention. The generator 160 supplies electricity to tankless water heater 104 for operation of thermostat controls, as well as electricity for operation of submersible pump 110. Output water tank 108 comprises output spigot 162 disposed in a lower portion of the output water tank 108, such that the output spigot 162 can be used to controllably release water from the output water tank 108 by gravity. Thus, no pump or electrical power is necessary to dispense water from output water tank 108 using this embodiment. Furthermore, since this embodiment comprises generator 160 as an on-board source of electricity, this embodiment is completely stand-alone, with its own electricity and input water source. As such, it is well suited for use in remote areas or any construction site where electricity and an external water source (e.g. from a municipal water system) are not available.

Figure 2:
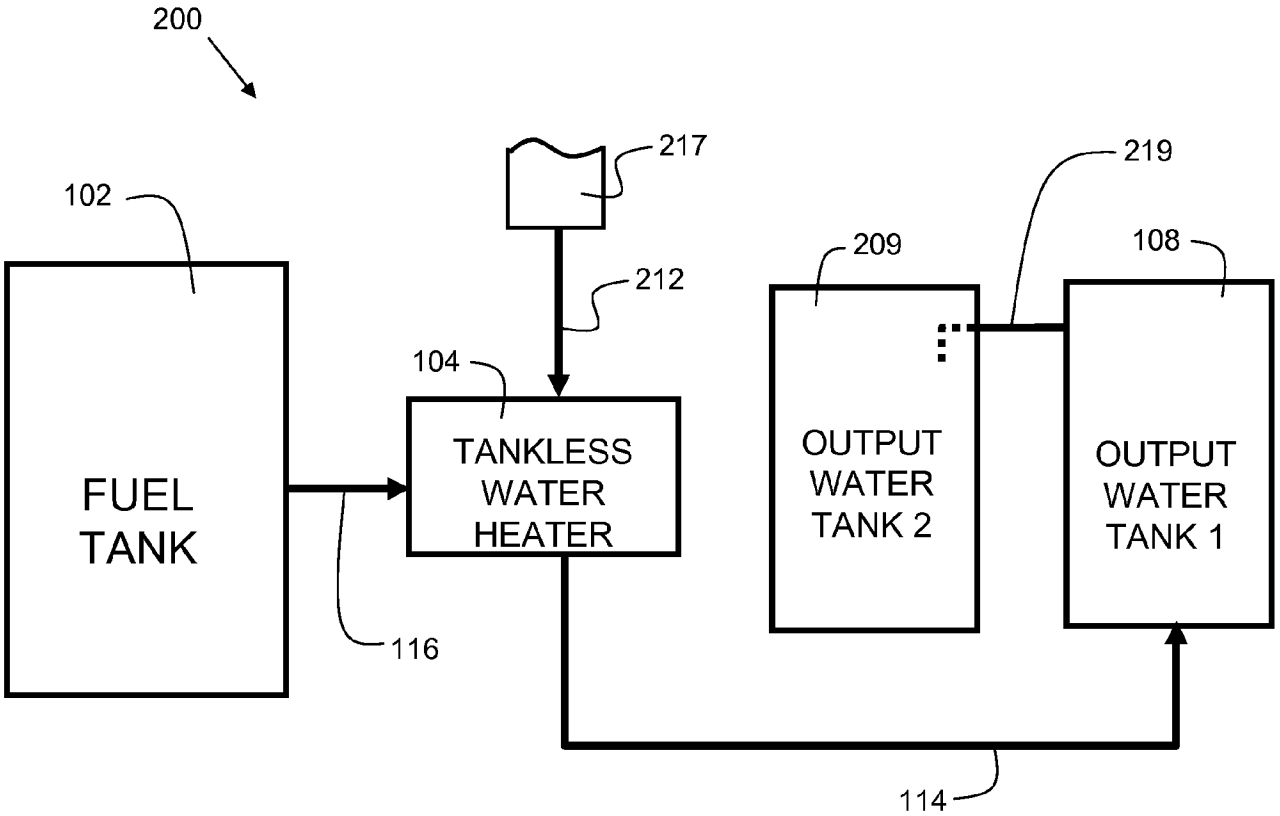
FIG. 2 shows a system diagram of another embodiment of the present invention.

FIG. 2 shows a system diagram of a heating system 200 in accordance with another embodiment of the present invention. In this embodiment, water is input to tankless water heater 104 via input conduit 212, which is in turn supplied from water tap 217. This embodiment is well-suited for a construction site where a water supply is available. In this case, there is not a need for the submersible pump shown in FIG. 1. The two water tanks 108 and 209 are configured as cascaded output tanks. Water exits water heater 104 via conduit 114, and enters output water tank 108. When water tank 108 is near full, water then travels via conduit 219 to water tank 209. This arrangement provides for a greater capacity of stored heated water, since two output tanks are used.

Figure 3:
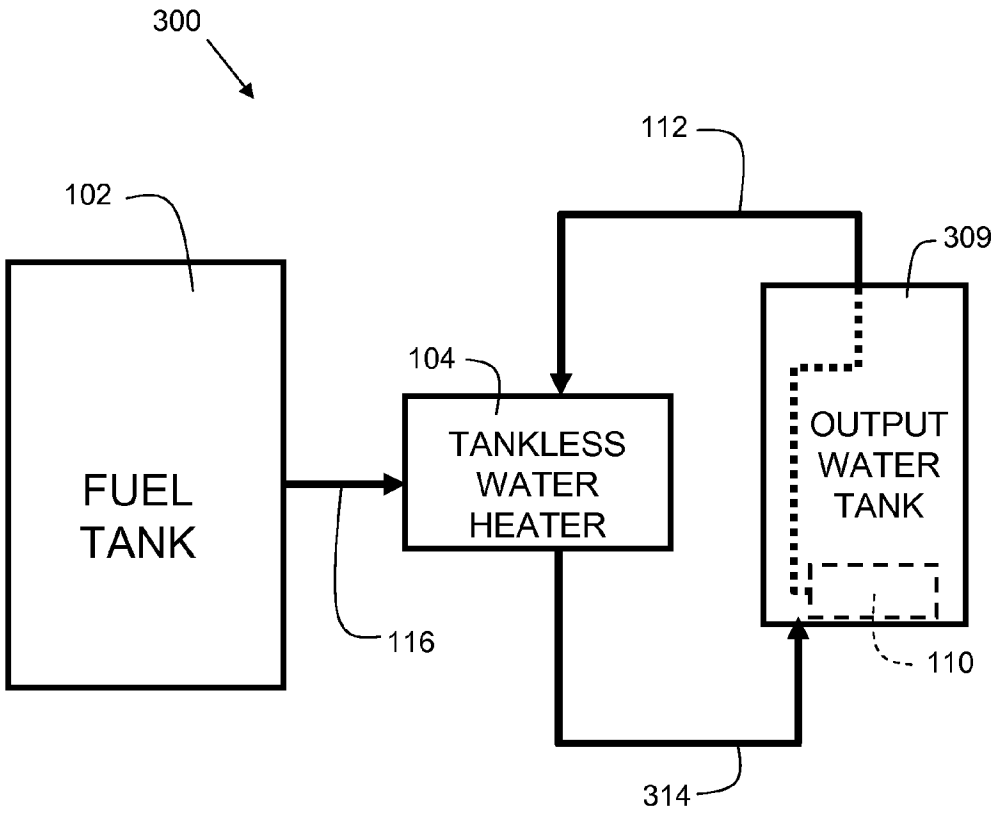
FIG. 3 shows a system diagram of another embodiment of the present invention.

FIG. 3 shows a system diagram of a heating system 300 in accordance with another embodiment of the present invention. In this embodiment, the heating system is in a recirculation configuration. To start, cold water may be initially dispensed into output water tank 309. The heating system 300 is then transported to a desired work site, and then operated in the recirculation configuration. Pump 110 continuously feeds water to water heater 104 via input conduit 112. Water exits the water heater 104 via conduit 314 and returns to output water tank 309.

Figure 4:
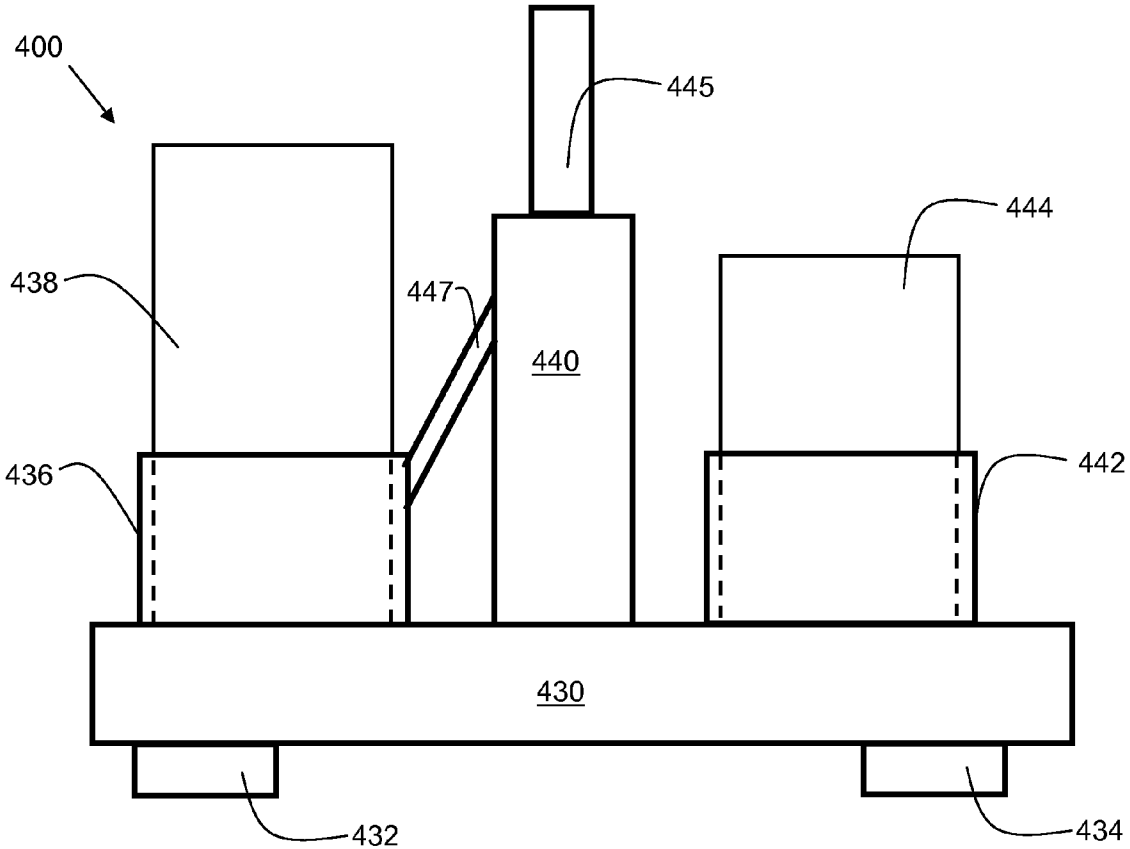
FIG. 4 shows a side view of an embodiment of the present invention.

FIG. 4 shows a side view of a heating system 400 in accordance with an embodiment of the present invention. Heating system 400 comprises platform (chassis) 430, which supports other components of heating system 400. Metal receptacles 432 and 434 are affixed to the underside of chassis 430. The receptacles 432 and 434 are of suitable size and spacing to accommodate a forklift, allowing for convenient moving of the heating system 400 at a construction site. Fuel tank holder 436 secures fuel tank 438. Water heater 440 is secured to chassis 430. Water tank holder 442 secures water tank 444. In one embodiment, water tank 444 is a 55 gallon drum. It will be recognized that other size water tanks may be used, and all feasible sizes are included within the scope of the invention. Water tank 444 may be insulated, and may also have a lid to help preserve water temperature. Vent 445 directs burned gases away from the ground. Support brace (mount) 447 serves to stabilize the heater.

Figure 5:
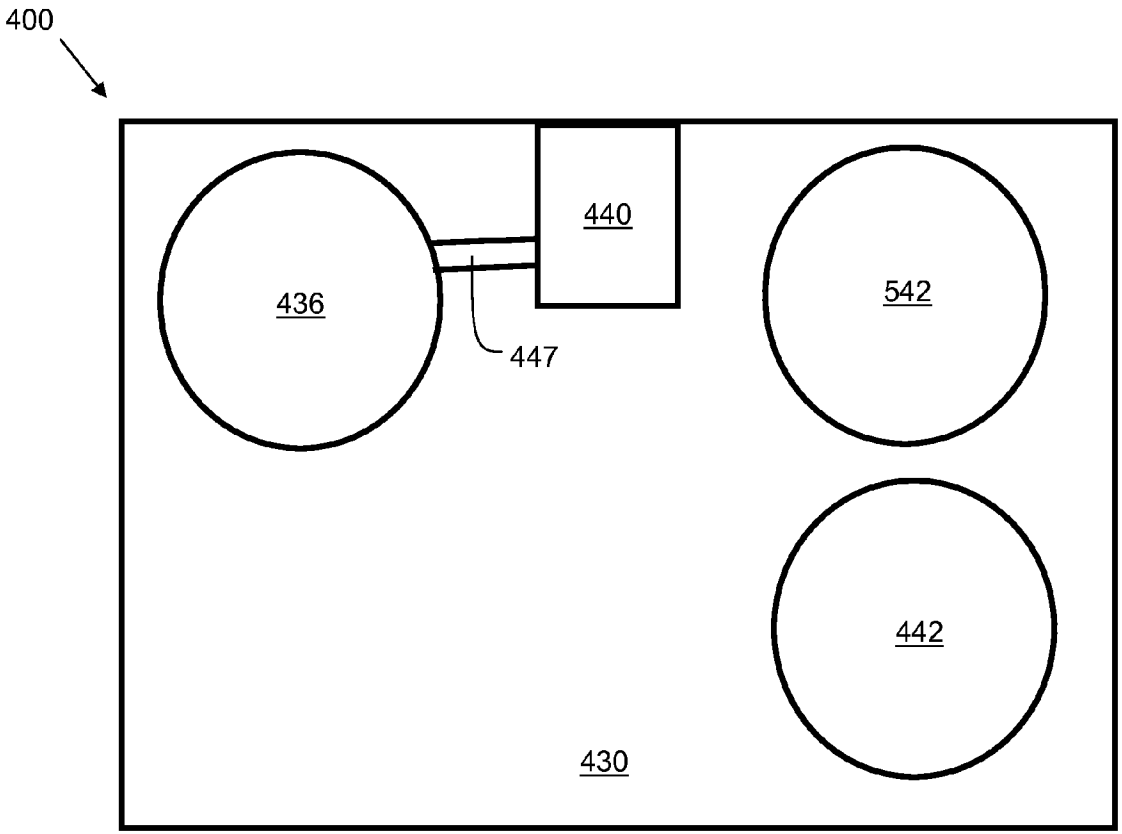
FIG. 5 shows a top view of the embodiment of FIG. 4.

FIG. 5 shows a top view of heater system 400 of FIG. 4. In this view, two water tank holders (442 and 542) are visible.

Figure 6:
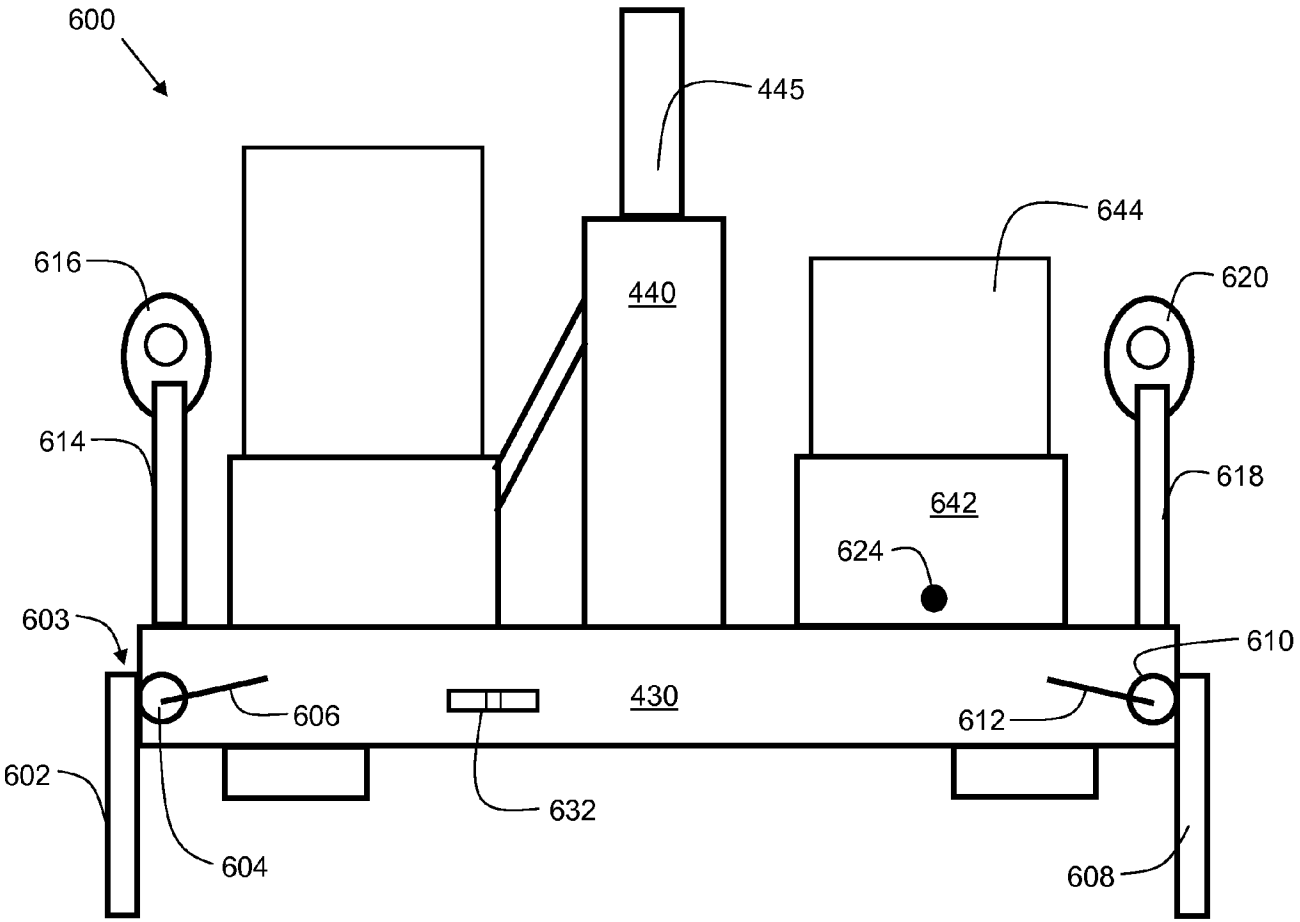
FIG. 6 shows a side view of another embodiment of the present invention.

FIG. 6 shows a side view of heater system 600 in accordance with another embodiment of the present invention. Heater system 600 is similar to heater system 400, with the addition of some other components. Heater system 600 further comprises an elevation system 603 to raise the chassis 430 to a predetermined height above the ground level. In the embodiment shown, elevation system 603 comprises a plurality of moveable legs. Movable leg 602 is controlled via pinion 604 which is attached to handle 606. A similar configuration exists on the opposite side with leg 608, pinion 610, and handle 612. Two other movable legs (not shown, but having a similar configuration to those shown) are present on the other corners of the chassis 430. Furthermore, tank holder 642 is adapted to provide a controllable conduit (spigot) 624 into water tank 644. By elevating chassis 430, water is dispensable from water tank 644 via spigot 624, where the water flows out due to gravity. A level indicator 632 may optionally be affixed to one or more sides of the chassis 430 to facilitate leveling of the heater system 600. The level indicator 632 may be a liquid-filled bubble level, or any other suitable device. Another level indicator may be affixed to another side of the chassis 430. The level indicators indicate the levelness of the chassis 430. The use of at least two level indicators allows the chassis 430 to be leveled both front-to-back and left-to-right. This can be useful when the heater system 600 is placed on ground that is not completely level. The legs (602 and 608, and the other legs not shown) are independently adjustable such that the chassis 430 may be positioned in a level orientation, regardless of whether the ground below it is level.

Heater system 600 also comprises lifting posts 614 and 618. Hoist fixtures, such as eyelets (616, 620) are affixed to the top of each lifting post. This allows heating system 600 to be lifted by a crane. This embodiment is well-suited for skyscraper construction, as the heating system 600 can be hoisted to the level where concrete mixing is occurring.

Figure 7:
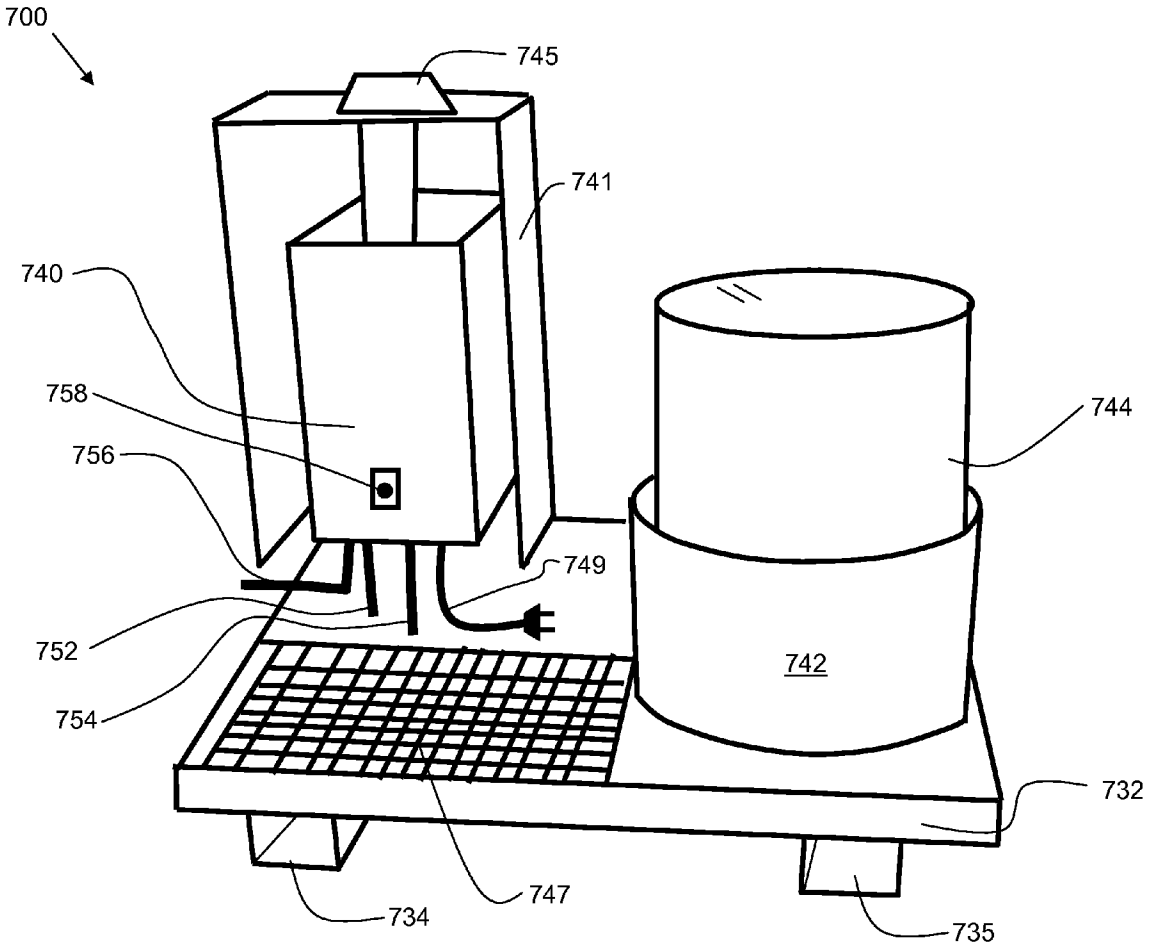
FIG. 7 shows a perspective view of another embodiment of the present invention.

FIG. 7 shows a perspective view of heater system 700 in accordance with another embodiment of the present invention. Heater system 700 comprises receptacles 734 and 735 for forklift transport as previously described. Water tank holder 742 secures water tank 744. Water heater 740 is secured to chassis 732. A portion of chassis 732 below water heater 740 is comprised of a mesh grate floor 747. This allows for convenient draining of water heater 740 upon completion of use. The water drains from water heater 740, through mesh grate floor 747, and safely onto the ground. Electrical cord 749 is used to supply power for the controls 758 of water heater 740, and any other components requiring electricity (e.g. submersible pump 110 of FIG. 1). Fuel supply line 756 supplies fuel (e.g. propane or natural gas) to heater 740. Cold water line 754 provides cold water to heater 740. That water is heated in heater 740 and exits via hot water line 752. In this embodiment, heater 740 is mounted to chassis 732, and protected by a heater cover 741. Heater cover 741 may be comprised of metal. The heater 740 vents burned gases through vent 745, thereby directing the burned gases away from the ground.

It will be recognized that embodiments of the invention may be produced in varying sizes, for example, for large-scale industrial environments as well as home applications. Embodiments of the invention are not limited to any particular size. The component parts are not limited to any particular size either.

It will also be recognized that the term "water" is used herein to encompass water and any other suitable liquid, aqueous solution or combination thereof. Therefore, the invention is not limited to use in heating of water, but also includes heating of all other liquids or solutions as well.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A water heating apparatus comprising:

a platform;

a tankless water heater attached to the platform, the tankless water heater comprising a water input and a water output;

a fuel tank holder attached to the platform, the fuel tank holder configured and disposed to secure a fuel tank; and a first water reservoir, wherein the first water reservoir is configured and disposed to receive heated water from the water output of the tankless water heater;

wherein the platform further comprises an elevation system, wherein the elevation system is configured and disposed to elevate the platform to a predetermined distance above the ground; and wherein the elevation system comprises a plurality of moveable legs disposed on the platform, wherein each moveable leg is adjustable independently of each other moveable leg, and wherein each moveable leg is configured and disposed to be adjusted by a corresponding pinion, wherein a handle is connected to each pinion, thereby enabling manual adjustment.

2. The water heating apparatus of claim 1, further comprising an input conduit, wherein the input conduit is configured and disposed to connect to an external water supply, and direct water into the water input of the tankless water heater.

3. The water heating apparatus of claim 1, further comprising:

a second water reservoir; and an input conduit, wherein the input conduit is configured and disposed to direct water from the second water reservoir into the water input of the tankless water heater.

4. The water heating apparatus of claim 2, further comprising:

a second water reservoir; and a conduit connecting the first water reservoir to the second water reservoir, whereby the second water reservoir is configured and disposed to receive heated water.

5. The water heating apparatus of claim 1, further comprising a combustion engine generator affixed to the platform, said generator configured and disposed to supply electricity to the tankless water heater.

6. The water heating apparatus of claim 1, wherein the platform further comprises a grated floor region disposed below the tankless water heater.

7. The water heating apparatus of claim 1, wherein the platform further comprises a pair of forklift receptacles disposed below the platform.

8. The water heating apparatus of claim 1, further comprising a first level indicator and a second level indicator, wherein the first level indicator and second level indicator are disposed on the platform, and wherein the first level indicator and second level indicator are configured and disposed to indicate the levelness of the platform.

9. The water heating apparatus of claim 3, further comprising an input pump, the input pump configured and disposed to pump water from the second water reservoir into the tankless water heater.

10. The water heating apparatus of claim 9, wherein the input pump is a submersible pump.

11. The water heating apparatus of claim 1, further comprising an output pump, the output pump configured and disposed to pump water from the first water reservoir.

12. The water heating apparatus of claim 1, further comprising an output spigot, the output spigot disposed in a lower portion of the first water reservoir, wherein the output spigot is configured and disposed to controllably release water from the first water reservoir.

13. A water heating apparatus comprising:

a platform;

a tankless water heater attached to the platform, the tankless water heater comprising a water input and a water output;

a fuel tank holder attached to the platform, the fuel tank holder configured and disposed to secure a fuel tank;

a first water reservoir, wherein the first water reservoir is configured and disposed to receive heated water from the water output of the tankless water heater;

a second water reservoir;

a submersible pump disposed within the second water reservoir, wherein the submersible pump is configured to pump water into the tankless water heater via an input conduit;

a pair of forklift receptacles disposed below the platform;

an elevation system, wherein the elevation system is configured and disposed to elevate the platform a predetermined distance above the ground;

wherein the elevation system comprises a plurality of moveable legs disposed on the platform, wherein each moveable leg is adjustable independently of each other moveable leg, and wherein each moveable leg is configured and disposed to be adjusted by a corresponding pinion, wherein a handle is connected to each pinion, thereby enabling manual adjustment;

a combustion engine generator affixed to the platform, said generator configured and disposed to supply electricity to the tankless water heater and submersible pump;

an output spigot, the output spigot disposed in a lower portion of the first water reservoir, wherein the output spigot is configured and disposed to controllably release water from the first water reservoir;

a first level indicator and a second level indicator, wherein the first level indicator and second level indicator are disposed on the platform, and wherein the first level indicator and second level indicator are configured and disposed to indicate the levelness of the platform;

a grated floor region disposed in the platform below the tankless water heater; and a plurality of hoist fixtures configured and disposed on the platform, thereby enabling hoisting of the water heating apparatus.

* * * * *